US006650067B1

(12) United States Patent
Shloush et al.

(10) Patent No.: US 6,650,067 B1
(45) Date of Patent: Nov. 18, 2003

(54) ELECTRONIC BALLAST FOR DISCHARGE LAMPS

(75) Inventors: Moshe Shloush, Knoxville, TN (US); James W. Dulaney, Oklahoma City, OK (US)

(73) Assignee: Aurora Lighting, Inc., Knoxville, TN (US)

( * ) Notice: Subject to any disclaimer, the term of this patent is extended or adjusted under 35 U.S.C. 154(b) by 0 days.

(21) Appl. No.: 10/145,420

(22) Filed: May 14, 2002

(51) Int. Cl.[7] ..... H05B 41/16

(52) U.S. Cl. ..... 315/247; 315/259; 315/284; 315/291; 315/307

(58) Field of Search ..... 315/247, 258, 315/259, 283, 284, 291, 292, 293, 307, DIG. 7

(56) References Cited

U.S. PATENT DOCUMENTS

| | | | | |
|---|---|---|---|---|
| 4,535,271 A | | 8/1985 | Holmes | 315/209 R |
| 5,019,959 A | | 5/1991 | MacDonald et al. | 363/134 |
| 5,225,742 A | | 7/1993 | Beasley | 315/307 |
| 5,416,687 A | | 5/1995 | Beasley | 363/44 |
| 5,426,350 A | | 6/1995 | Lai | 315/244 |
| 5,680,016 A | | 10/1997 | Valcke | 315/307 |
| 5,796,216 A | | 8/1998 | Beasley | 315/307 |
| 5,883,475 A | | 3/1999 | Beasley | 315/307 |
| 5,900,701 A | * | 5/1999 | Guhilot et al. | 315/307 |
| 5,914,571 A | | 6/1999 | Beasley | 315/244 |
| 6,300,722 B1 | | 10/2001 | Parra | 315/209 R |
| 6,414,448 B1 | * | 7/2002 | Noone et al. | 315/291 |
| 6,486,616 B1 | * | 11/2002 | Liu et al. | 315/291 |

* cited by examiner

*Primary Examiner*—Don Wong
*Assistant Examiner*—Tuyet T. Vo
(74) *Attorney, Agent, or Firm*—Luedeka, Neely & Graham, P.C.

(57) ABSTRACT

An electronic ballast operates a gaseous discharge lamp. The electronic ballast includes a filter circuit for removing noise from an electrical power signal. The power factor of the filtered power signal is adjusted by a power factor correction circuit. The power factor correction circuit includes a programmable inductor circuit having a plurality of selectable inductance values for varying the amount of power factor adjustment to accommodate operation of different lamp types and/or different lamp wattages. A power supply circuit converts electrical power received from the filtered power signal to provide low level power for operating the electronic ballast. An output circuit receives the corrected power signal produced by the power factor correction circuit and produces an electrical signal to ignite and operate the discharge lamp. The output circuit includes an ignition circuit for producing an oscillating voltage signal to ignite the lamp, and an operating circuit produces an oscillating current signal which operates the discharge lamp after ignition. A control circuit controls the operation of the electronic ballast. A current monitor is used to determine when the lamp is ignited. The ability of the electronic ballast to accommodate different lamps is enhanced by providing the ignition circuit with a programmable inductor circuit to oscillate the voltage signal at different frequencies. A similar effect is achieved by providing the operating circuit with a programmable resistor circuit having a plurality of programmable resistance values.

26 Claims, 3 Drawing Sheets

ELECTRONIC BALLAST FOR DISCHARGE LAMPS

FIELD OF THE INVENTION

The present invention relates generally to operation of gaseous discharge lamps. More particularly, the present invention relates to a transformerless electronic ballast for operating gaseous discharge lamps.

BACKGROUND OF THE INVENTION

Ballast circuits are generally used in gaseous discharge lighting systems to regulate the supply of electrical power to the lamp. The type and size of lamp to be operated are typically determinative of how the ballast circuit will be configured. For example, high intensity discharge (HID) lamps such as mercury, metal halide, and high pressure sodium lamps are usually operated at high wattage and require a different ballast circuit than lamps such as fluorescent lamps which operate at relatively low wattage. Even among lamps of the same type (i.e., mercury, metal halide, high pressure sodium, fluorescent, etc.) the specific lamp wattage can vary, which in turn requires a corresponding variance of elements within the ballast circuit in order to optimize operation of the lamp. As a result, conventional ballast circuits are unable to accommodate proper operation of different lamp types and/or lamps of the same type which operate at different wattages.

What is needed, therefore, is a versatile ballast circuit that eliminates difficulties and disadvantages of prior art ballast circuits.

SUMMARY OF THE INVENTION

The present invention eliminates the difficulties and disadvantages of the prior art by providing an electronic ballast for operating a discharge lamp and is particularly well suited for operation of high intensity discharge lamps such as metal halide and high pressure sodium. The electronic ballast includes a filter circuit for removing noise from an electrical power signal provided by a source of electrical power, producing a filtered power signal. A power factor correction circuit adjusts the power factor of the filtered power signal and produces a corrected power signal. Included in the power factor correction circuit is a first programmable inductor circuit having a plurality of selectable inductance values for varying the amount of power factor adjustment. This programmable inductor circuit allows the power factor correction circuit to adjust the power factor as needed for operating different lamps. A power supply circuit converts electrical power received from the filtered power signal to a power level sufficient to operate the electronic ballast. An output circuit receives the corrected power signal and produces an electrical signal to ignite and operate the discharge lamp. The output circuit includes an ignition circuit for producing an oscillating voltage signal for igniting the discharge lamp, and an operating circuit for producing an oscillating current signal to operate the discharge lamp after ignition. In a preferred embodiment, the ignition circuit oscillates the voltage signal in the high frequency range of about 60 KHz to about 500 KHz. A control circuit controls the overall operation of the electronic ballast.

The control circuit may use various types of sensor feedback to control operation of the ballast circuit. For example, the ballast circuit may include a current monitor for monitoring the electrical signal provided to the discharge lamp. The current monitor signal can then be used by the control circuit to determine when the lamp is lit so that it knows when to switch from an ignition mode to an operating mode.

The ability of the ballast circuit to accommodate operation of different discharge lamps is further enhanced by including within the ignition circuit a second programmable inductor circuit having a plurality of selectable inductance values for oscillating the voltage signal at different frequencies. Additionally, the operating circuit may include a programmable resistor circuit having a plurality of resistance values for supporting operation of a plurality of different types of discharge lamps.

The control circuit preferably includes a programmable digital signal processor. The digital signal processor is programmed to control switches used in connection with the programmable inductor circuits and the programmable resistor circuit. The switches have multiple switch positions corresponding to the inductance and resistance values, and each switch is controlled by the digital signal processor to position the switches so as to optimize operation of the particular discharge lamp that is connected to the ballast circuit.

Current supplied to the discharge lamp may be controlled by power MOSFET switches in combination with opto-isolators that are controlled by the digital signal processor to boost current above that otherwise achievable by the digital signal processor alone. To reduce the potential for noise, the power MOSFET switches may be of the double gated variety.

BRIEF DESCRIPTION OF THE DRAWINGS

Preferred embodiments of the invention will now be described in further detail. Other features, aspects, and advantages of the present invention will become better understood with regard to the following detailed description, appended claims, and accompanying drawings (which are not to scale) where:

DETAILED DESCRIPTION OF THE PREFERRED EMBODIMENT(S)

Figure 1:
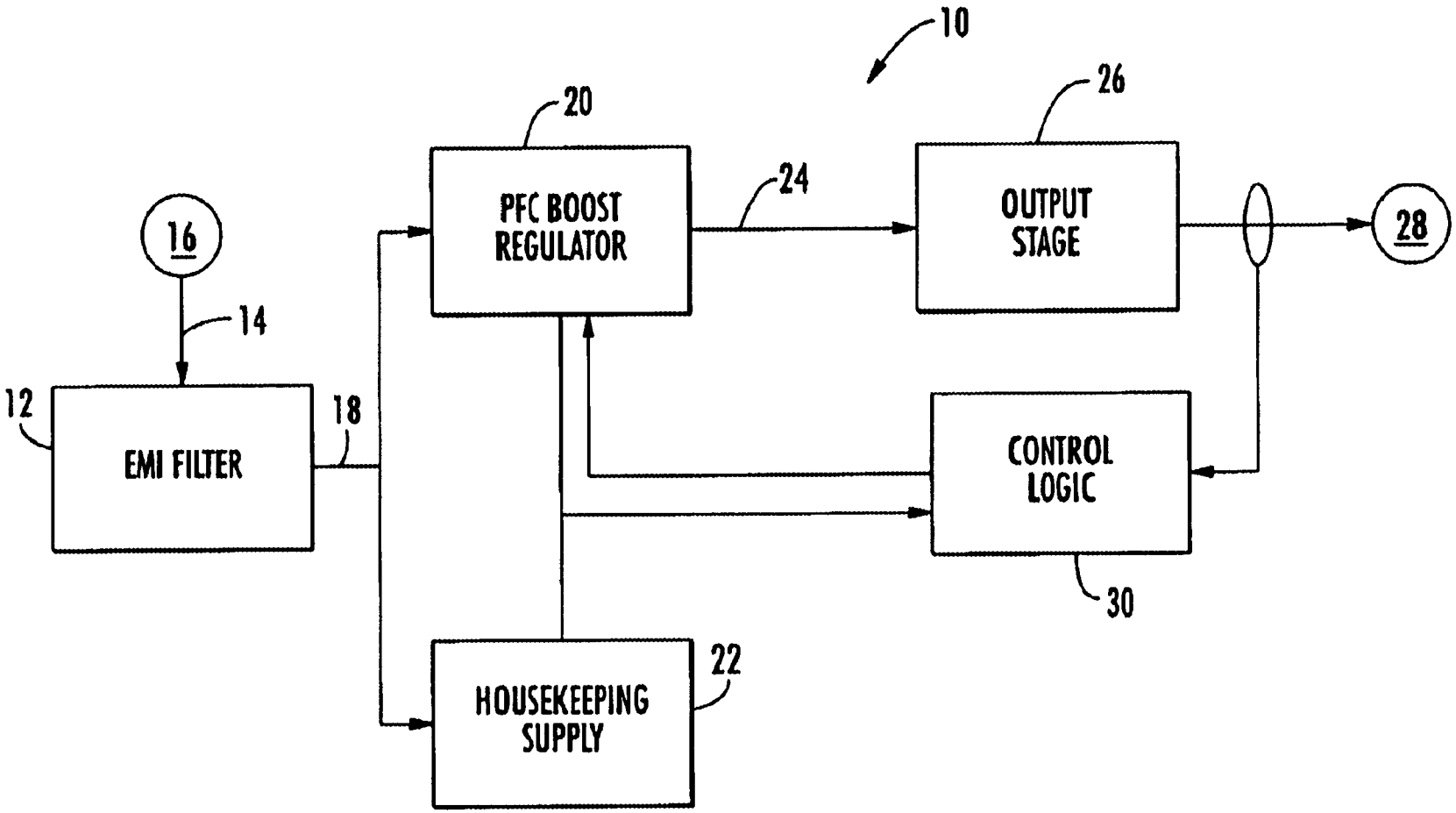
FIG. 1 is a functional block diagram of an electronic ballast circuit according to the present invention.

Preferred embodiments of the present invention will now be described with reference to the accompanying drawings, wherein like reference characters designate like or similar parts throughout. The terminology used herein is intended to be interpreted in its broadest reasonable manner, even though it is being utilized in conjunction with a detailed description of certain specific preferred embodiments of the present invention. This is further emphasized below with respect to some particular terms used herein. Any terminology intended to be interpreted by the reader in any restricted manner will be overtly and specifically defined as such in this specification.

FIG. 1 illustrates a functional block of an electronic ballast circuit 10 according to a preferred embodiment of the invention. The ballast circuit 10 includes an electromagnetic interference (EMI) filter circuit 12 which functions to remove noise from an electrical power signal 14 provided by an electrical power source 16. In a preferred embodiment, the filter circuit 12 includes a low-pass filter. Also preferably, the EMI filter circuit 12 is tunable to accommodate different types and levels of noise in the incoming power signal 14.

The filtered power signal 18 is provided to a power factor correction (PFC) boost regulator circuit 20 and a power supply housekeeping circuit 22. The power factor correction circuit 20 adjusts the filtered power signal to correct for power factor. As more fully explained below, the power factor can be corrected either automatically through sensor feedback or manually through dip switches. Preferably, the power factor correction circuit 20 includes one or more circuit elements with variable parameters to enhance the ballast circuit's ability to accommodate different types and/or wattages of discharge lamps.

The housekeeping/power supply circuit 22 functions to convert the incoming filtered power signal to a power level sufficient to operate the electronic ballast 10. In a preferred embodiment, the ballast circuit 10 is operated by a 15-volt supply provided by the power supply circuit 22. A voltage regulator within the power supply circuit 22 maintains the supplied power between about 12 to 15 volts dc. The housekeeping/power supply circuit 22 also provides overheat protection by shutting down operation of the ballast circuit 10 when an overheat condition exists.

The corrected power signal 24 produced by the power factor correction circuit 20 is received by an output circuit 26 which functions to ignite and operate a gaseous discharge lamp 28. Discharge lamps suitable for use with the ballast circuit 10 include mercury, metal halide, and high pressure sodium lamps. Preferably, the output circuit 26 includes one or more circuit elements with variable parameters to enhance the ballast circuit's ability to accommodate different types and/or wattages of discharge lamps.

A control logic circuit 30 controls operation of the ballast circuit 10, including ignition and operation of the lamp 28. Sensor feedback on line 32 is utilized by the control circuit 30 to determine when the lamp 28 has ignited.

A preferred embodiment of the ballast circuit 10 shown in FIG. 1 will now be described with reference to FIGS. 2 and 3. Each of the functional blocks of FIG. 1 are generally shown by use of broken line blocks in FIG. 2. Within the filter circuit 12, power surges experienced on incoming power on lines 40*a*, 40*b* are suppressed by a surge suppressor 42. The ballast circuit 10 can accommodate either ac or dc power. Inductor 44 and capacitors 46–50 act as a low-pass filter to remove unwanted components from the power signal. A full bridge circuit 52 rectifies the power signal before it is received by the power factor correction circuit 20 and the housekeeping/power supply circuit 22. Parameters of the filter circuit 12 may be tunable to provide different levels of conditioning of the incoming power signal as desired or needed.

The power factor correction circuit 20 includes a programmable inductor circuit having a plurality of selectable inductance values for varying the amount of power factor adjustment and enhancing the ability of the ballast circuit 10 to ignite and operate different lamps 28. In a preferred embodiment, the programmable inductor circuit includes a programmable inductor 54 having a primary winding 54' and a second winding 54" which function to adjust the power factor of the incoming power signal and produce a corrected power signal on line 56. Inductor 54 includes a plurality of selectable inductance values for varying the amount of power factor adjustment as needed. For example, a higher inductance value increase the amount of power factor compensation and a lower inductance value decrease the effective power factor compensation. In a preferred embodiment, each winding 54', 54" of inductor 54 has an associated switch 58, 60. The switches 58, 60 have multiple switch positions which tap the inductor winding at different points so that each switch position results in a different inductance value, and hence, a different amount of power factor adjustment. The positions of switches 58, 60 are controlled by the control circuit 30.

In an alternate embodiment, the programmable inductor circuit includes a plurality of inductors with each inductor having a different inductance value. In this alternate embodiment, the control circuit 30 operates to select an individual inductor to adjust the power factor of the power signal.

The corrected power signal 56 is provided to the housekeeping/power supply circuit 22 and the output circuit 26. Within the power supply circuit 22, resistors 60, 62 form the basic elements of a voltage divider which provides low level voltage for operating the ballast circuit 10. A voltage regulator 64 regulates the voltage divider output to maintain a desired voltage level for operating the ballast circuit 10. In a preferred embodiment, voltage regulator 64 maintains a voltage range of between about 5 volts dc to about 15 volts dc.

Figure 2:
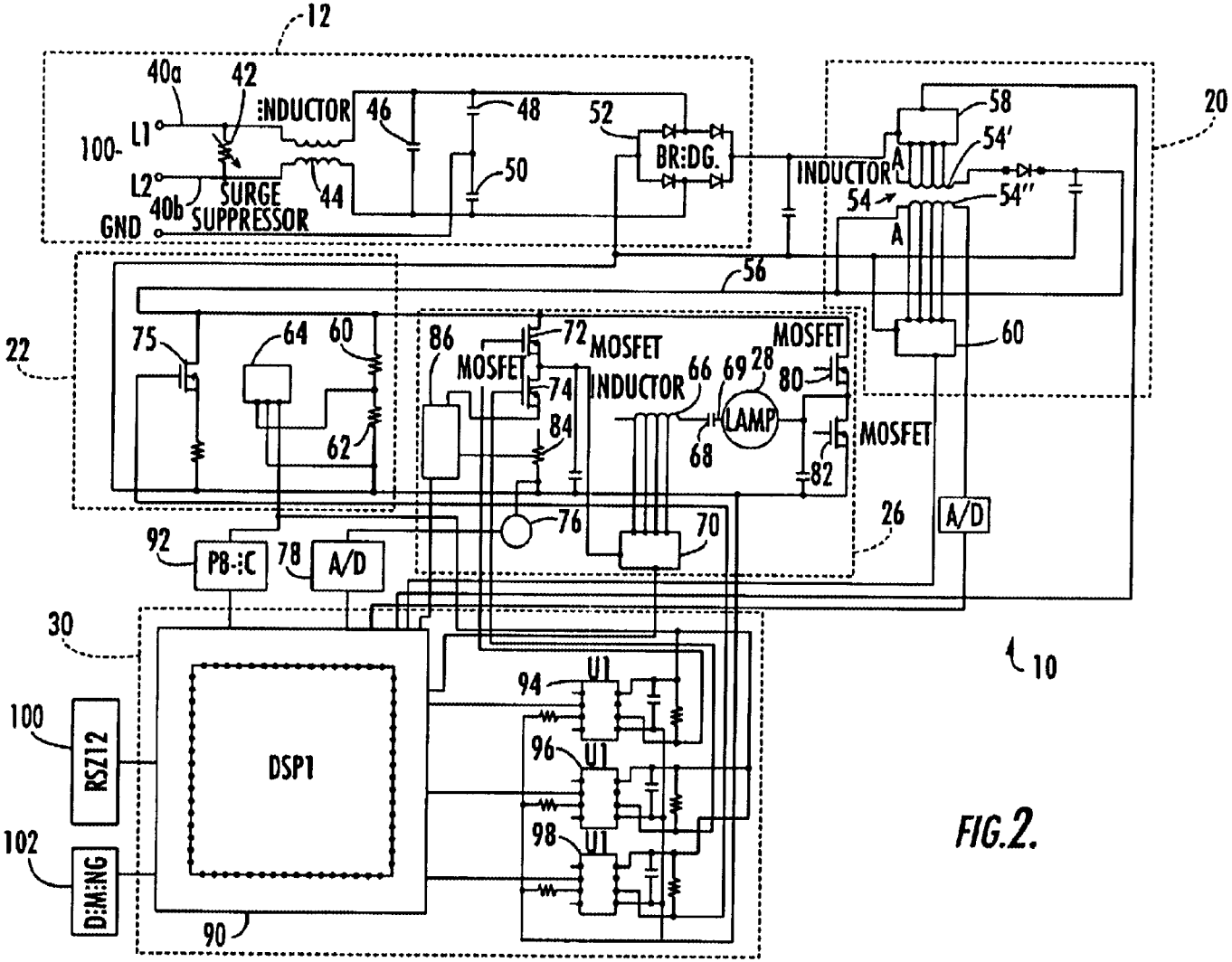
FIG. 2 is a schematic diagram of an electronic ballast circuit according to the present invention.
Figure 3:
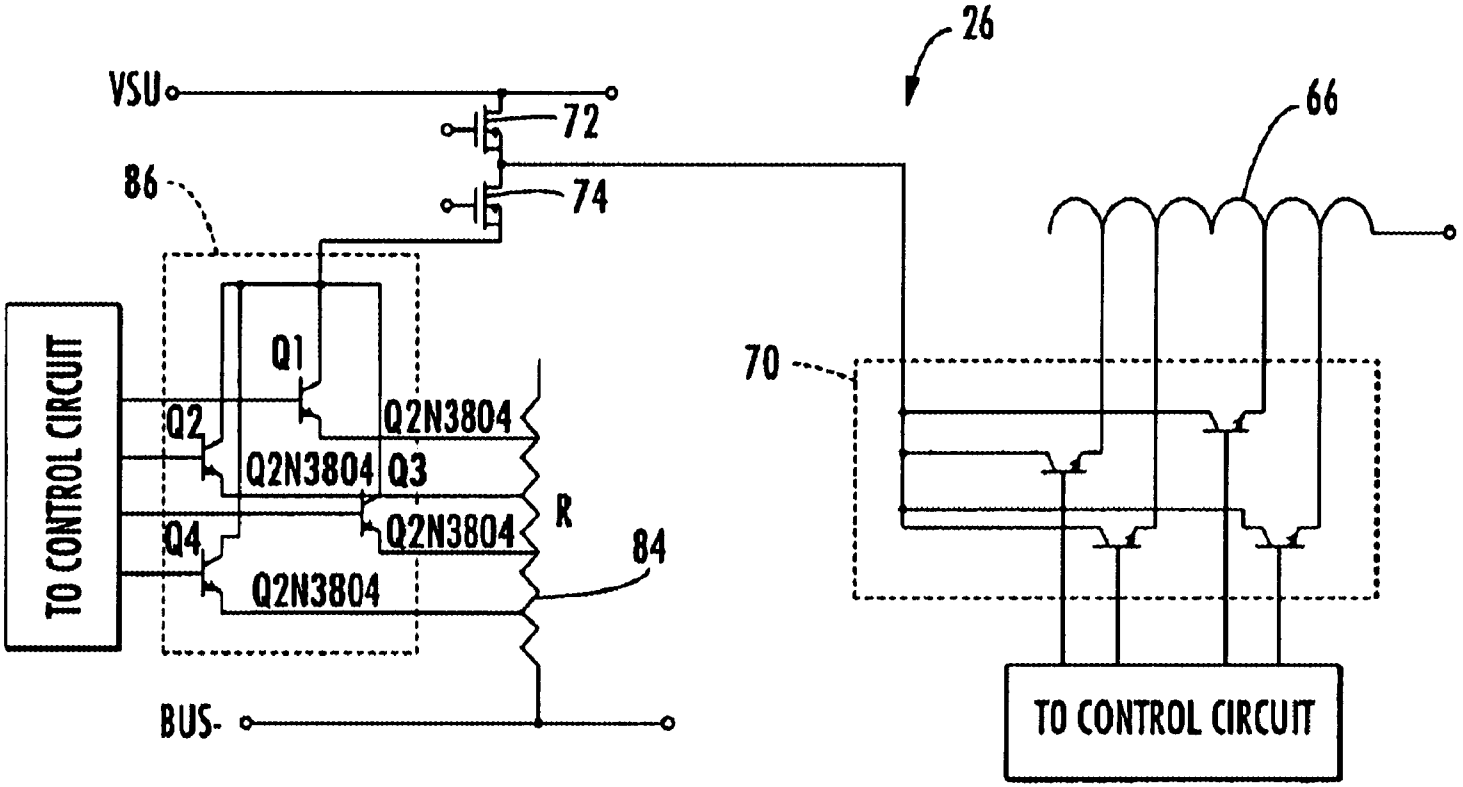
FIG. 3 is a schematic diagram showing elements of an output circuit according to the present invention.

With continued reference to FIG. 2, the output circuit 26 includes a resonant inductor 66 and capacitor 68 which form part of an ignition circuit that provides an oscillating voltage signal on line 69 to ignite the lamp 28. For purposes of simplifying the schematic of FIG. 2, the lamp 28 is shown as part of the output circuit 26. Preferably, the voltage signal 69 is oscillated at high frequency between about 60 KHz to about 500 KHz and at high voltage of about 11 KV or greater.

To enhance the ability of the ballast circuit 10 to accommodate lamps 28 of different types and wattages, the resonant inductor 66 is programmable and includes a plurality of selectable inductance values for varying the frequency and voltage as needed. For example, an increase in the inductance value of inductor 66 functions to increase the voltage and oscillation frequency, while a decrease in the inductance of inductor 66 results in a corresponding decrease of voltage and frequency. In a preferred embodiment, the resonant inductor 66 has an associated switch 70 with multiple switch positions which tap the inductor winding at different points so that each switch position results in a different inductance value, and hence, a different ignition signal on line 69. The position of switch 70 is controlled by the control circuit 30. A more detailed illustration of components within the output circuit 26 is shown in FIG. 3.

In an alternate embodiment, the resonant inductor 66 is replaced with a plurality of inductors with each inductor having a different inductance value. In this alternate embodiment, the control circuit 30 operates to select an individual inductor to adjust the voltage signal on line 69 as needed. Electrical power for igniting the lamp 28 is provided to switch 70 by a pair of power MOSFET devices 72, 74.

During initial power up of the ballast circuit 10, the lamp 28 is seen as a very high impedance device with little or no current flowing through the output circuit to the lamp 28. Upon ignition of 15 the lamp 28, current flows through the output circuit to the lamp 28. A current sensor 76 senses the start of current flow to the lamp 28 and provides such an indication to the control circuit 30. An analog-to-digital converter 78 digitizes the current sensor output for use by the control circuit 30. The control circuit 30 then controls operation of the lamp 28 by establishing an oscillating current signal on line 69 across the lamp 28. More precisely, after ignition of the lamp 28, current flows from resistor 84 and power MOSFET devices 72, 74, through switch 70 and resonant inductor 66, and through the lamp 28 and power MOSFET devices 80, 82. Thus, the programmable resistor 84, switches 86, 70, resonant inductor 66, and power MOSFET devices 72, 74, 80, 82 form the major components of an operating circuit for maintaining operation of the lamp 28 after ignition. The power MOSFET devices 72, 74, 80, 82 are also preferably double gated transistors.

While power MOSFET devices 72, 74 are shown in a half bridge configuration, it will be understood that in an alternate embodiment a full MOSFET bridge with two additional power MOSFET devices may be provided as part of the operating circuit so as to increase the amount of current available for operating the lamp 28. Preferably, the current signal 69 is oscillated at high frequency between about 60 KHz to about 500 KHz, or greater. Oscillating the voltage signal 69 during ignition and the current signal 69 during operation at high frequency eliminates most or all of the acoustic distortion and strobbing that typically occurs when discharge lamps are operated at lower frequencies. It also helps to increase the life of the lamp 28.

A programmable resistor 84 having a plurality of programmable resistance values enables the level of current flow across the lamp 28 to be varied as needed, which in turn enhances the ability of the ballast circuit 10 to operate lamps of different types and/or wattages. In a preferred embodiment, the programmable resistor 84 has an associated switch 86 with multiple switch positions which tap the resistor 84 at different points so that each switch position results in a different resistive value, and hence, a different level of current flow across the lamp 28. As configured in FIG. 2, an increase in the resistive value of resistor 84 results in a corresponding decrease in current, while a decrease in the resistive value of resistor 84 functions to increase current across the lamp 28. The position of switch 86 is controlled by the control circuit 30.

In an alternate embodiment, the programmable resistor 84 is replaced with a plurality of resistors with each resistor having a different resistive value. In this alternate embodiment, the control circuit 30 operates to select an individual resistor to set the flow of operating current across the lamp 28 as needed.

The control circuit 30 embodiment of FIG. 2 includes a programmable processing circuit which is preferably a digital signal processor 90 having a plurality of programmable I/Os with each I/O programmed or coded to perform a specific function within the ballast circuit 10. For example, for each of the switches 58, 60, 70, 86 described above, the digital signal processor 90 includes an I/O which is programmed to control the switch. The control circuit 30 also includes opto-isolators 94–98 which function to drive power MOSFET devices 72, 74, 75. In an alternate embodiment, a microprocessor or other type of programmable processing circuit is used in place of a digital signal processor 90. In the alternate embodiment of a full bridge MOSFET circuit within the output circuit 26 described above, an additional two opto-isolators would be required to drive the two additional power MOSFET devices.

In a preferred embodiment, the digital signal processor (DSP) 90 is supplied by Texas Instruments under part no. TMS 320LC2402A. Programming of the I/Os to perform the functions of the ballast circuit 10 is within the ability of one skilled in the art. A power supply 92 converts the low voltage output of the housekeeping/power supply circuit 22 to an even lower voltage, preferably between about 3.3 volts dc to about 5.0 volts dc, for operating the DSP 90. In an alternate embodiment of the control circuit 30, a microprocessor such as a Pentium III processor provided by Intel is utilized in lieu of a DSP 90.

A communications port 100 is provided for programming of the DSP 90. In a preferred embodiment, the communications port 100 is an industry standard RS232 port. A dimming interface 102 is also provided to enable the DSP 90 to receive an ambient light sensor output for dimming of the lamp 28. For ambient light sensors which produce an analog output, the sensor output would be converted to digital format (such as by an analog-to-digital convertor) for processing by the DSP 90.

The foregoing description details certain preferred embodiments of the present invention and describes the best mode contemplated. It will be appreciated, however, that no matter how detailed the foregoing description appears, the invention can be practiced in many ways without departing from the spirit of the invention. Therefore, the above mentioned description is to be considered exemplary, rather than limiting, and the true scope of the invention is that defined in the following claims and any equivalents thereof.

What is claimed is:

1. An electronic ballast for operating a discharge lamp, the electronic ballast comprising:

a filter circuit for removing noise from an electrical power signal provided by a source of electrical power, producing a filtered power signal;

a power factor correction circuit for adjusting the power factor of the filtered power signal to produce a corrected power signal, said power factor correction circuit including a first programmable inductor circuit having a plurality of selectable inductance values for varying the amount of power factor adjustment;

a power supply circuit for converting electrical power received from the filtered power signal to a power level sufficient to operate the electronic ballast;

an output circuit for receiving the corrected power signal and producing an electrical signal to ignite and operate the discharge lamp, said output circuit including:

an ignition circuit for producing an oscillating voltage signal for igniting the discharge lamp; and an operating circuit for producing an oscillating current signal to operate the discharge lamp after ignition; and a control circuit for controlling operation of the electronic ballast.

2. The electronic ballast of claim 1 wherein said oscillating voltage signal is oscillated at a frequency of about 60 KHz or greater.

3. The electronic ballast of claim 1 wherein said ignition circuit includes a second programmable inductor circuit having a plurality of programmable inductance values for supporting operation of a plurality of different types of discharge lamps.

4. The electronic ballast of claim 1 wherein said operating circuit includes a programmable resistor circuit having a plurality of programmable resistance values for supporting operation of a plurality of different types of discharge lamps.

5. The electronic ballast of claim 1 wherein said filter circuit includes a low pass filter.

6. The electronic ballast of claim 1 wherein said output circuit includes:

a plurality of power MOSFET switches for controlling electrical current to the discharge lamp; and a plurality of opto-isolators for supplying electrical current to the power MOSFET switches, each of said plurality of opto-isolators being controlled by said control circuit.

7. The electronic ballast of claim 1 wherein said output circuit includes a plurality of double gated transistors.

8. The electronic ballast of claim 1, further comprising a current monitor for monitoring the electrical signal provided to the discharge lamp, producing a current monitor signal corresponding to the electrical current sensed by the current monitor.

9. The electronic ballast of claim 8 wherein said control circuit is further operable to control the electrical signal produced by the output circuit based on the current monitor signal.

10. The electronic ballast of claim 1 wherein said control circuit includes a programmable processing circuit.

11. The electronic ballast of claim 10 wherein said first programmable inductor circuit includes a first switch having a plurality of selectable switch positions corresponding to said plurality of selectable inductance values, the switch position of said first switch being controlled by the programmable processing circuit.

12. The electronic ballast of claim 10 wherein said ignition circuit includes a second programmable inductor circuit having a plurality of selectable inductance values for oscillating the voltage signal at different frequencies, said second programmable inductor circuit including a second switch having a plurality of selectable switch positions corresponding to said plurality of selectable inductance values for oscillating the voltage signal at different frequencies, the switch position of said second switch being controlled by the programmable processing circuit.

13. The electronic ballast of claim 10 wherein said operating circuit includes a programmable resistor circuit having a plurality of programmable resistance values for supporting operation of a plurality of different types of discharge lamps, said programmable resistor circuit including a resistance value switch having a plurality of selectable switch positions corresponding to said plurality of programmable resistance values, the switch position of said resistance value switch being controlled by the programmable processing circuit.

14. An electronic ballast for operating a discharge lamp, the electronic ballast comprising:

a filter circuit for removing noise from an electrical power signal provided by a source of electrical power, producing a filtered power signal;

a power factor correction circuit for adjusting the power factor of the filtered power signal to produce a corrected power signal, said power factor correction circuit including a first programmable inductor circuit having a plurality of selectable inductance values for varying the amount of power factor adjustment;

a power supply circuit for converting electrical power received from the filtered power signal to a power level sufficient to operate the electronic ballast;

an output circuit for receiving the corrected power signal and producing an electrical signal to ignite and operate the discharge lamp, said output circuit including:

an ignition circuit for producing an oscillating voltage signal for igniting the discharge lamp, said ignition circuit including a second programmable inductor circuit having a plurality of programmable inductance values for supporting operation of a plurality of different types of discharge lamps; and an operating circuit for producing an oscillating current signal to operate the discharge lamp after ignition; and a control circuit for controlling operation of the electronic ballast.

15. The electronic ballast of claim 14 wherein said oscillating voltage signal is oscillated at a frequency of about 60 KHz or greater.

16. The electronic ballast of claim 14 wherein said operating circuit includes a programmable resistor circuit having a plurality of programmable resistance values for supporting operation of a plurality of different types of discharge lamps.

17. The electronic ballast of claim 14 wherein said filter circuit includes a low pass filter.

18. The electronic ballast of claim 14 wherein said output circuit includes:

a plurality of power MOSFET switches for controlling electrical current to the discharge lamp; and a plurality of opto-isolators for supplying electrical current to the power MOSFET switches, each of said plurality of opto-isolators being controlled by said control circuit.

19. The electronic ballast of claim 14 wherein said output circuit includes a plurality of double gated transistors.

20. The electronic ballast of claim 14, further comprising a current monitor for monitoring the electrical signal provided to the discharge lamp, producing a current monitor signal corresponding to the electrical current sensed by the current monitor.

21. The electronic ballast of claim 20 wherein said control circuit is further operable to control the electrical signal produced by the output circuit based on the current monitor signal.

22. The electronic ballast of claim 14 wherein said control circuit includes a programmable processing circuit.

23. The electronic ballast of claim 22 wherein said first programmable inductor circuit includes a first switch having a plurality of selectable switch positions corresponding to said plurality of selectable inductance values, the switch position of said first switch being controlled by the programmable processing circuit.

24. The electronic ballast of claim 22 wherein said second programmable inductor circuit includes a second switch having a plurality of selectable switch positions corresponding to said plurality of selectable inductance values for oscillating the voltage signal at different frequencies, the switch position of said second switch being controlled by the programmable processing circuit.

25. The electronic ballast of claim 22 wherein said operating circuit includes a programmable resistor circuit having a plurality of programmable resistance values for supporting operation of a plurality of different types of discharge lamps, said programmable resistor circuit including a resistance value switch having a plurality of selectable switch positions corresponding to said plurality of programmable resistance values, the switch position of said resistance value switch being controlled by the programmable processing circuit.

26. An electronic ballast for operating a discharge lamp, the electronic ballast comprising:

a filter circuit for removing noise from an electrical power signal provided by a source of electrical power, producing a filtered power signal;

a power factor correction circuit for adjusting the power factor of the filtered power signal to produce a corrected power signal, said power factor correction circuit including a first programmable inductor circuit having a plurality of selectable inductance values for varying the amount of power factor adjustment;

a power supply circuit for converting electrical power received from the filtered power signal to a power level sufficient to operate the electronic ballast;

an output circuit for receiving the corrected power signal and producing an electrical signal to ignite and operate the discharge lamp, said output circuit including:

an ignition circuit for producing an oscillating voltage signal for igniting the discharge lamp, said ignition circuit including a second programmable inductor circuit having a plurality of selectable inductance values for oscillating the voltage signal at different frequencies; and an operating circuit for producing an oscillating current signal to operate the discharge lamp after ignition, said operating circuit including a programmable resistor circuit having a plurality of programmable resistance values for supporting operation of a plurality of different types of discharge lamps; and a control circuit for controlling operation of the electronic ballast.

* * * * *